US010263312B2

(12) United States Patent
Oster et al.

(10) Patent No.: US 10,263,312 B2
(45) Date of Patent: Apr. 16, 2019

(54) PLURALITY OF DIELECTRIC WAVEGUIDES INCLUDING DIELECTRIC WAVEGUIDE CORES FOR CONNECTING FIRST AND SECOND SERVER BOARDS

(71) Applicant: Intel Corporation, Santa Clara, CA (US)

(72) Inventors: Sasha N. Oster, Chandler, AZ (US); Aleksandar Aleksov, Chandler, AZ (US); Georgios C. Dogiamis, Chandler, AZ (US); Telesphor Kamgaing, Chandler, AZ (US); Adel A. Elsherbini, Chandler, AZ (US); Shawna M. Liff, Scottsdale, AZ (US); Johanna M. Swan, Scottsdale, AZ (US); Brandon M. Rawlings, Chandler, AZ (US); Richard J. Dischler, Bolton, MA (US)

(73) Assignee: Intel Corporation, Santa Clara, CA (US)

( * ) Notice: Subject to any disclaimer, the term of this patent is extended or adjusted under 35 U.S.C. 154(b) by 0 days.

(21) Appl. No.: 15/282,050

(22) Filed: Sep. 30, 2016

(65) Prior Publication Data

US 2018/0097268 A1 Apr. 5, 2018

(51) Int. Cl.

| | |
|---|---|
| ***H01P 3/12*** | (2006.01) |
| ***H01P 3/16*** | (2006.01) |
| ***H01P 11/00*** | (2006.01) |
| ***H01P 3/14*** | (2006.01) |

(52) U.S. Cl.

CPC ..... *H01P 3/122* (2013.01); *H01P 3/14* (2013.01); *H01P 3/16* (2013.01); *H01P 11/006* (2013.01)

(58) Field of Classification Search

CPC .. H01P 3/121; H01P 3/122; H01P 3/14; H01P 11/001; H01P 11/002; H01P 11/006

USPC ..... 333/1, 239

See application file for complete search history.

(56) References Cited

U.S. PATENT DOCUMENTS

| | | | | |
|---|---|---|---|---|
| 3,157,847 | A | 11/1964 | Williams | |
| 5,230,990 | A | 7/1993 | Iwasaki et al. | |
| 2002/0130739 | A1* | 9/2002 | Cotton | H05K 1/0218 333/238 |
| 2003/0137371 | A1* | 7/2003 | Saitoh et al. | H01P 3/122 333/239 |

(Continued)

FOREIGN PATENT DOCUMENTS

| | | | |
|---|---|---|---|
| EP | 1394581 | A1 | 3/2004 |

OTHER PUBLICATIONS

"International Application Serial No. PCT/US2017/049350, International Search Report dated Dec. 18, 2017", 3 pgs.

(Continued)

*Primary Examiner* — Benny Lee

(74) *Attorney, Agent, or Firm* — Schwegman Lundberg & Woessner, P.A.

(57) ABSTRACT

A method of making a waveguide ribbon that includes a plurality of waveguides comprises joining a first sheet of dielectric material to a first conductive sheet of conductive material, patterning the first sheet of dielectric material to form a plurality of dielectric waveguide cores on the first conductive sheet, and coating the dielectric waveguide cores with substantially the same conductive material as the conductive sheet to form the plurality of waveguides.

22 Claims, 10 Drawing Sheets

(56) References Cited

U.S. PATENT DOCUMENTS

| | | | | |
|---|---|---|---|---|
| 2010/0109817 | A1* | 5/2010 | Kodama | H01P 3/12 333/239 |
| 2011/0084047 | A1 | 4/2011 | Yeo et al. | |
| 2012/0195564 | A1 | 8/2012 | Mathai et al. | |
| 2012/0306587 | A1* | 12/2012 | Strid et al. | H01P 3/16 333/1 |
| 2014/0285294 | A1* | 9/2014 | Haroun et al. | H01P 3/16 333/256 |
| 2016/0380329 | A1* | 12/2016 | Shiroshita et al. | H01P 11/006 333/239 |

OTHER PUBLICATIONS

"Internationai Application Serial No. PCT/US2017/049350, Written Opinion dated Dec. 18, 2017", 9 pgs.

* cited by examiner

PLURALITY OF DIELECTRIC WAVEGUIDES INCLUDING DIELECTRIC WAVEGUIDE CORES FOR CONNECTING FIRST AND SECOND SERVER BOARDS

TECHNICAL FIELD

Embodiments pertain to high speed interconnections in electronic systems, and more specifically to waveguides for implementing communication interfaces between electronic devices.

BACKGROUND

As more electronic devices become interconnected and users consume more data, the demand on server system performance continues to increase. More and more data is being stored in internet "clouds" remote from devices that use the data. Clouds are implemented using servers arranged in server clusters (sometimes referred to as server farms). The increased demand for performance and capacity has led server system designers to look for ways to increase data rates and increase the server interconnect distance in electronic switching architectures while keeping power consumption and system cost manageable.

Within server systems and within high performance computing architectures there can be multiple levels of interconnect between electronic devices. These levels can include within blade interconnect, within rack interconnect, rack-to-rack interconnect and rack-to-switch interconnect. Shorter interconnects (e.g., within rack and some rack-to-rack) are traditionally implemented with electrical cables (e.g., Ethernet cables, co-axial cables, twin-axial cables, etc.) depending on the required data rate. For longer distances, optical cables are sometimes used because fiber optic solutions offer high bandwidth for longer interconnect distances.

However, as high performance architectures emerge (e.g., 100 Gigabit Ethernet), traditional electrical approaches to device interconnections that support the required data rates are becoming increasingly expensive and power hungry. For example, to extend the reach of an electrical cable or extend the bandwidth of an electrical cable, higher quality cables may need to be developed, or advanced techniques of one or more of equalization, modulation, and data correction may be employed which can increase power requirements of the system and add latency to the communication link. For some desired data rates and interconnect distances, there is presently not a viable solution. Optical transmission over optical fiber offers a solution, but at a severe penalty in power and cost. The present inventors have recognized a need for improvements in the interconnection between electronic devices.

DETAILED DESCRIPTION OF THE INVENTION

The following description and the drawings sufficiently illustrate specific embodiments to enable those skilled in the art to practice them. Other embodiments may incorporate structural, logical, electrical, process, and other changes. Portions and features of some embodiments may be included in, or substituted for, those of other embodiments. Embodiments set forth in the claims encompass all available equivalents of those claims.

Traditional electrical cabling may not meet the emerging requirements for electronic systems such as server clusters. Fiber optics may meet the performance requirements, but may result in a solution that is too costly and power hungry.

Figure 1:
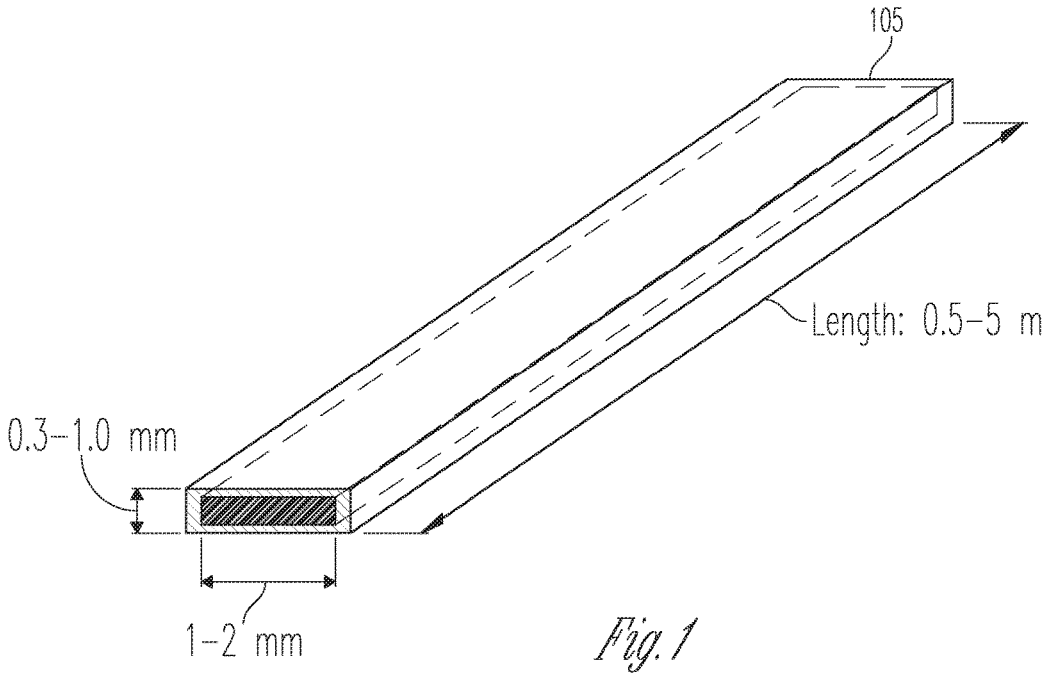
FIG. 1 is an illustration of a waveguide in accordance with some embodiments.

FIG. 1 is an illustration of an embodiment of a waveguide. A waveguide can be used to propagate electromagnetic waves including electromagnetic waves having a wavelength in millimeters (mm) or micrometers (μm). A transceiver end antenna, or waveguide launcher, can be used to send electromagnetic waves along the waveguide from the transmitting end. A transceiver at the receiving end can receive the propagated signals using a receiving end antenna or waveguide launcher. Waveguides offer the bandwidth needed to meet the emerging requirements.

Figure 2:
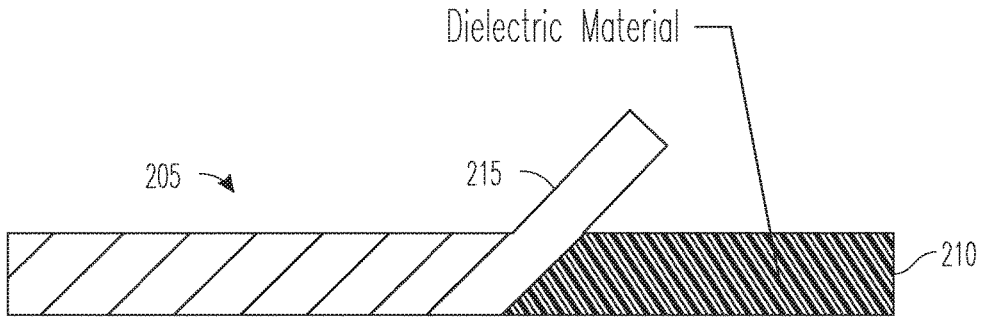
FIG. 2 is an illustration of a method of making a waveguide in accordance with some embodiments.

The waveguide 105 may have a length of two to five meters (2-5 m). In some embodiments, the length of the waveguide can be one half meter (0.5 m) or longer. Electromagnetic waves travel along the length of the waveguide. The cross section of the waveguide may have a height of 0.3-1.0 mm and a width of 1-2 mm, or may have larger dimensions. In certain embodiments, the waveguides are dimensioned to carry signals having frequencies of 30 Gigahertz (GHz) to 300 GHz. In certain embodiments, the waveguides are dimensioned to carry signals having frequencies of 100 GHz to 900 GHz. The cross section of the waveguide in FIG. 1 is rectangular, but the cross section may be circular, elliptical, square, or another more complex geometry. The waveguide includes conductive material such as metal. The inside of the waveguide can be hollow and air filled. The conventional methods for manufacturing waveguides are typically complex and expensive. Alternate methods to produce waveguides that are less complex at reduced cost are desired FIG. 2 is an illustration of an embodiment of a method of making a waveguide 205. The method includes covering a waveguide core with a sheet of conductive material without using a sputtering process. An elongate waveguide core 210 is formed that includes dielectric material. In certain embodiments the waveguide core is formed using one or a combination of polyethylene (PE), polytetrafluoroethylene (PTFE), perfluoroalkoxy alkanes (PFA), fluorinated ethylene propylene (FEP), polyvinylidene fluoride (PVDF), or ethylene-tetraflouroethylene (ETFE). The dielectric waveguide core may be formed using a drawing process that draws a continuous core from a source material, or formed using an extrusion process. In some embodiments, the waveguide core has a solid center. In some embodiments, the waveguide core is formed to have a tubular shape and the center is hollow. In some embodiments, the waveguide core is formed to have multiple small tubes or lumens.

To cover the waveguide core with a conductive layer, tape 215 or ribbon made of a conductive material is wrapped around the outside surface of the dielectric waveguide core to form the conductive sheet around the core. In some embodiments, the tape includes metal and the tape can be a foil ribbon. The metallic tape can include one or more of copper, gold, silver, and aluminum. In some embodiments, the tape includes a conductive polymer, such as a polyaniline (PANI), or poly(3,4-ethylenedioxythiophene) polystyrene sulfonate (PEDOT:PSS) for example. The conductive tape wrapped around the waveguide core material may include an adhesive on at least one surface of the conductive tape to provide good adhesion to the waveguide and to the tape itself. The adhesive layer can be very thin (e.g., down to a monolayer of the adhesive material) to minimize impact on the waveguide performance.

The waveguide core 210 may be wrapped as part of a continuous process. The conductive tape may be dispensed from a tape dispensing unit as the dielectric material passes the dispensing unit. One or both of the dielectric core and the dispensing unit may be rotated about the center axis of the waveguide core to spin the tape around the waveguide core. The waveguide core is moved relative to the dispensing unit in a direction along the center axis of the waveguide core as the conductive tape is dispensed. The thickness of the conductive layer can be changed by changing the thickness of the tape or by changing the rate at which one of both of the waveguide core and the dispensing unit are moved. The desired thickness of the conductive layer is determined by the conductivity of the conductive material and the frequency of the signals transported on the waveguide. In some embodiments, the thickness of the conductive layer formed by the wrapping is one micrometer (1 μm) or less. After the dielectric core is wrapped around the outside surface of the waveguide core, the waveguide may be cut to the desired length. If the tape cannot be tightly wound or an adhesive cannot be used in the waveguide, a heat shrinkable tape can be used in conjunction with a thermal treatment to shrink the tape to provide a tight placement around the waveguide core.

Figure 3A:
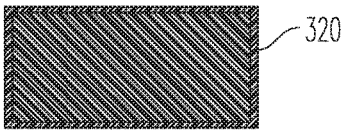
FIGS. 3A-3D are illustrations of cross sections of waveguides in accordance with some embodiments.
Figure 3B:
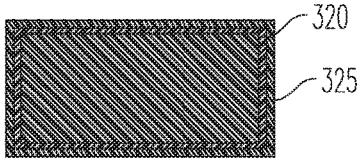
Figure 3C:
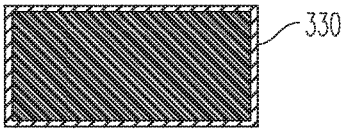
Figure 3D:
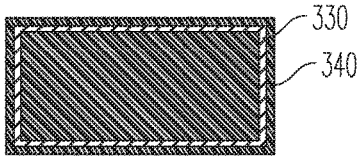

FIGS. 3A-3D are illustrations of some embodiments of a cross section of waveguides. The cross section shown has a rectangular shape, but the cross section need not be rectangular and may be circular, elliptical, square, or another more complex geometry. The waveguides include a conductive layer. In certain embodiments, the conductive coating is 1 μm or greater. In FIG. 3A, the tape includes a conductive polymer 320. Some conductive polymer may need protective coating. In FIG. 3B, the tape includes a conductive polymer 320 paired with a protective polymer 325. The conductive polymer and the protective polymer may be included as multiple layers of the same tape wound around the waveguide core, or the conductive polymer and the protective polymer may be provided as two separate tape layers, wound at the same time or separately. In FIG. 3C, the tape includes metal 330, such as a metallic foil. Some metals (e.g., copper) may be susceptible to oxidation or corrosion, and the metal tape is paired with a protective polymer. In FIG. 3D, the metallic tape or foil 330 is paired with an additional conductive coating, such as a conductive polymer 340. In some embodiments, a braid of metallic foil is added to the waveguide after metallic foil is applied. This may help to provide good contact at the foil/core interface.

Figure 4:
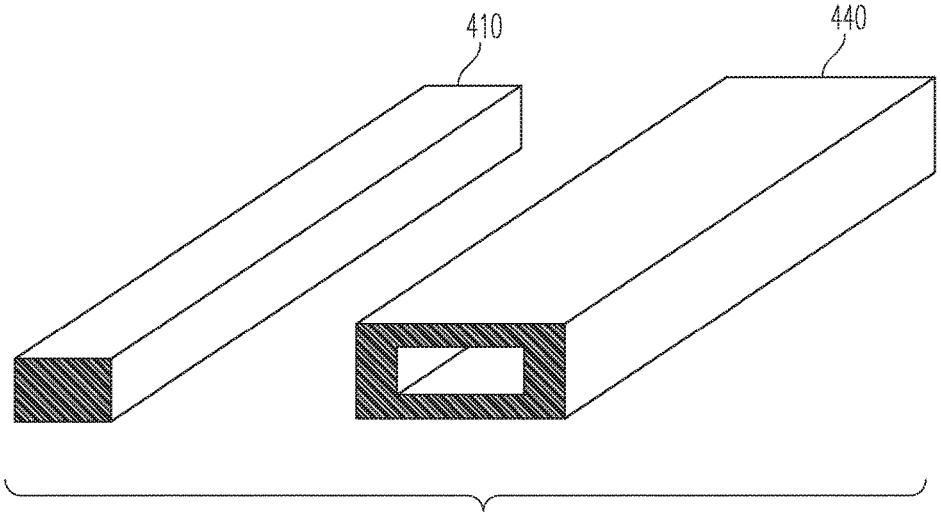
FIG. 4 is an illustration of components used in making a waveguide in accordance with some embodiments.

FIG. 4 is an illustration of components used in making a waveguide. In this approach of making a waveguide, a sleeve 440 of conductive material is arranged over the waveguide core 410. The sleeve is then shrink wrapped over the waveguide core (e.g., using a thermal treatment) to form a conductive layer over waveguide core.

The waveguide core 410 may be formed of dielectric material. In some embodiments, the waveguide core is uniformly composed of dielectric material, and in some embodiments the dielectric material of the core is disposed on a different material that may be retained in the core or later removed (e.g., by etching). In some embodiments, the waveguide core has a tubular shape and includes a hollow center. To form a waveguide core with a hollow center, the core may include a sacrificial layer upon which the dielectric material of the core is disposed. An etching material may then be used to remove the sacrificial layer of the center. Holes may be formed (e.g., drilled or laser-drilled) into the dielectric material to facilitate etching away of the center. In variations, the holes are formed after the conductive outer layer is placed on the waveguide core. The holes may be oriented and spaced to avoid any interference with wave propagation in the finished waveguide. In further variations, the holes are pre-formed in the sleeve 440 before it is placed around the waveguide core. In other embodiments, a slit may be formed along the dielectric material to facilitate etching away of the center. The center of the core may left hollow (e.g., air filled) or the hollowed center may subsequently be filled with a material different from the sacrificial layer material.

In certain embodiments the sleeve 440 includes a conductive polymer that is placed around the outside surface of the waveguide core. In certain embodiments, the sleeve includes conductive polymer and a protective outer coating placed around the outside surface of the waveguide core as shown in FIG. 3B. In certain embodiments the sleeve includes a metal placed around the outside surface of the waveguide core. In certain embodiments, the sleeve includes both metal and a protective outer coating around the outside surface of the waveguide core as shown in FIG. 3D. In some embodiments, the sleeve may have a slit on one side to make arrangement over the waveguide core easier. The waveguide core 410 may be wider at one end than the other to facilitate application of the sleeve. When the sleeve is placed over the core, the sleeve is shrink wrapped to provide a tight placement around the waveguide core. If the waveguide core 410 is formed using a drawing process, the sleeve may be placed over the waveguide core as part of the drawing process. The waveguide can be made overly long and then cut to the desired lengths.

Which approach (wound tape or sleeve) is used to form the waveguide conductive sheet may depend on the geometry of the waveguide core. If the waveguide core has a cross section with smooth corners (e.g., a circle or oval) the tape-winding method may be desired. If the waveguide core has a cross section that includes corners (e.g., a rectangle or square) the shrink-wrapped approach may be more desirable due to susceptibility of the tape to tearing, although either approach may be applied to any shape of waveguide core.

Other approaches can be used to make the waveguide. According to some embodiments, the conductive layer of the waveguide can be formed by applying a liquid or paste that includes a conductive material (e.g., a conductive polymer or a metal) to the outside surface of the waveguide core. In some embodiments, the liquid includes any combination of metallic particles, conductive polymers, and non-metallic conductive particles, such as graphene sheets, carbon nanotubes, and graphite particles. The conductive material can be applied to the waveguide core by immersing the waveguide core into a container of the liquid. The waveguide core may be solid or may have a tubular structure. The tubular structure may have a cross section of a circle, oval, rectangle or square. In some embodiments, the waveguide core is drawn through the container of the liquid as part of a drawing process. The coated waveguide core may be dried or heated. In certain embodiments, after the waveguide core is coated with the conductive material, the coated core is sintered to produce the desired conductive properties.

The dielectric core may be fed through different tanks or baths to coat or plate the waveguide core with different liquid or paste materials to obtain the desired conductivity and resilience. For example, the waveguide core may be first placed in a tank or bath that applies a primer coating to the waveguide core prior to being placed in a tank or bath that applies the conductive material to the waveguide core. After the conductive material is applied, the waveguide core may be placed in a tank or bath to apply a protective coating to the waveguide core to protect the conductive material from oxidation or humidity.

In other embodiments, the conductive liquid is sprayed onto the waveguide core, or a conductive paste is brushed onto the waveguide core. The waveguide core may be dried or heated at different stages. In certain embodiments, sintering steps may be provided at different stages of coatings. In some variations, sintering can involve a laser or photonic sintering process if the dielectric material of the waveguide core is sensitive to thermal sintering temperatures.

Figure 5:
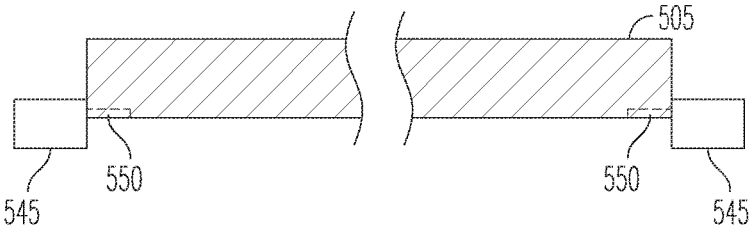
FIG. 5 is another illustration of a waveguide in accordance with some embodiments.

FIG. 5 is an illustration of another embodiment of a waveguide. The waveguide 505 includes a layer of conductive tape would around a waveguide core. The ends of the waveguide can be operatively connected to transceivers 545 and antennas 550 or waveguide launchers. The waveguide link can be used in connections among servers in a server cluster or server farm.

Figure 6:
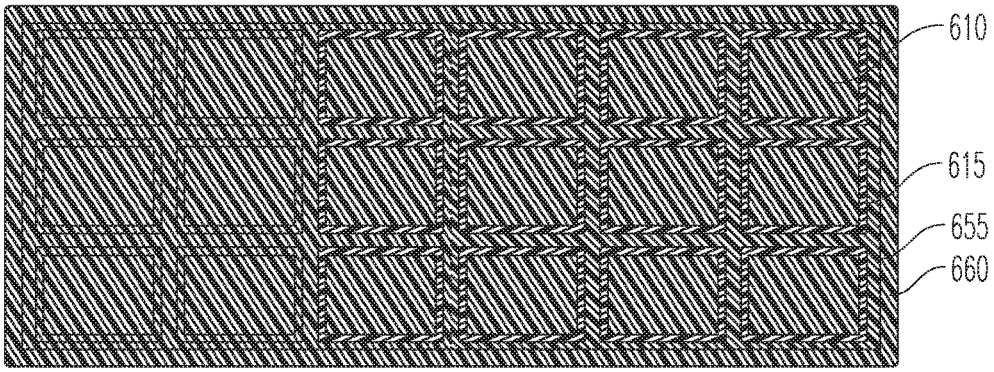
FIG. 6 is an illustration of waveguides combined into a bundle according to some embodiments.

According to some embodiments, individual waveguides can be combined into ribbons of waveguides or bundles of waveguides. FIG. 6 is an illustration of waveguides combined into a bundle. Cross sections of eighteen waveguides arranged in three rows of six waveguides are shown in the example of FIG. 6. A waveguide ribbon may include one row of waveguides. Each waveguide includes a conductive coating 615 around a dielectric waveguide core 610. The waveguide bundle may include a dielectric material 655 between the waveguides and a jacket 660 arranged around the bundle of waveguides. The dielectric material 655 filling space between the waveguides may be different from the dielectric material used to make the wave guide core. Instead being fabricated individually, multiple waveguides can be fabricated into ribbons or bundles at the same time.

FIGS. 7A-7D are illustrations of an embodiment of a method of making a waveguide ribbon that includes multiple waveguides. The example begins with a dielectric sheet 765 as in FIG. 7 or a roll of dielectric material. The dielectric material of the sheet or roll can include one or more of PE, PTFE, PFA, FEP, PVDF, or ETFE. The dielectric material of the sheet or roll can include a printed circuit board or electronic packaging substrate material (e.g., Rogers 3003, or RO3003). The dielectric sheet 765 may be selected that has the appropriate properties for the waveguide application. These properties can include the dielectric constant of the material and the thickness of the material. In an example intended to be illustrative and non-limiting, for an operating frequency band of 90-140 gigahertz (GHz), a dielectric material with a dielectric constant of 2 should have a thickness or height of about 0.7 mm.

Figure 7A:
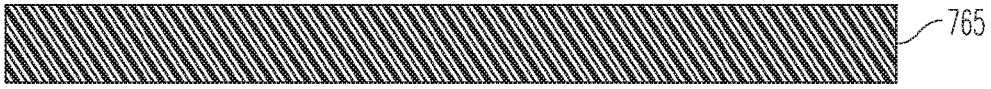
FIGS. 7A-7F are illustrations of an embodiment of a method of making multiple waveguides in accordance with some embodiments.
Figure 7B:
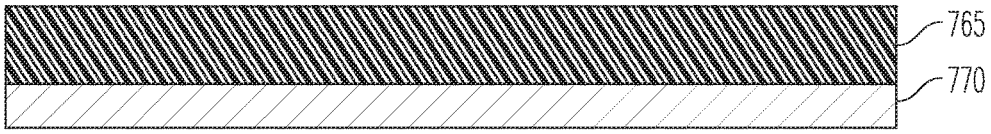

The dielectric sheet is joined to a sheet of conductive material. The conductive material can be metallic or can include a conductive polymer, such as PANI, or PEDOT:PSS for example. As shown in FIG. 7B, the dielectric sheet 765 can be laminated to the conductive sheet 770. One or both of the sheets may be roughened chemically and an adhesion agent applied to one or both of the layers. A laminator can be used to apply the appropriate amount of heat and pressure to adhere the sheets together. In some embodiments, an adhesive layer is applied to one or both of the dielectric sheet 765 and the conductive sheet 770 and the sheets are adhered together.

Figure 7C:
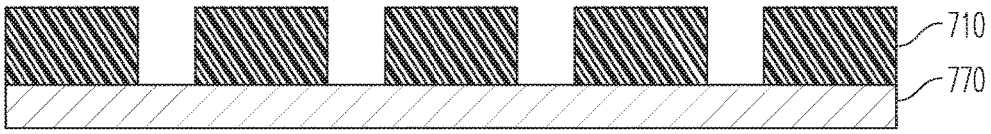

As shown in FIG. 7C, the dielectric sheet can be patterned to remove material from the adhered sheets to form multiple parallel dielectric waveguide cores 710 on the conductive sheet 770. In some embodiments, the dielectric sheet is cut using one or both of mechanical cutting (e.g., scoring using a blade or cutting with a saw) and laser cutting. In some embodiments, the dielectric material is patterned using directional etching. The dielectric material is photo-patterned and the material is etched to remove dielectric material and form the dielectric waveguide cores. In some embodiments, the dielectric sheet is patterned by stamping the dielectric material on the first conductive sheet or embossing the dielectric material to form the dielectric waveguide cores. The patterning results in waveguide cores of the appropriate cross section. For the example where the waveguides are to be used for an operating frequency band of 90-140 GHz and the dielectric material has a dielectric constant of 2, the width of the waveguide cores should be 1.4 mm (e.g., a cross section of 0.7 mm by 1.4 mm).

Figure 7D:
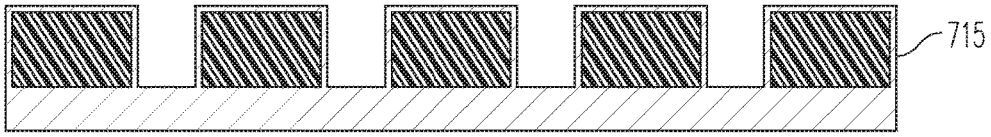

The formed dielectric waveguide cores are coated with substantially the same conductive material as the conductive sheet to form the plurality of waveguides. As shown in FIG. 7D, the dielectric waveguide cores are coated with a conductive layer 715 by spraying, plating, or brushing the conductive material onto the exposed surfaces of the dielectric waveguide cores.

Figure 8A:
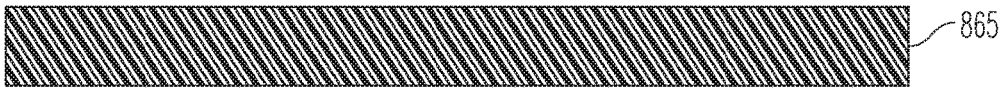
FIGS. 8A-8D are illustrations of another embodiment of a method of making multiple waveguides in accordance with some embodiments.
Figure 8B:
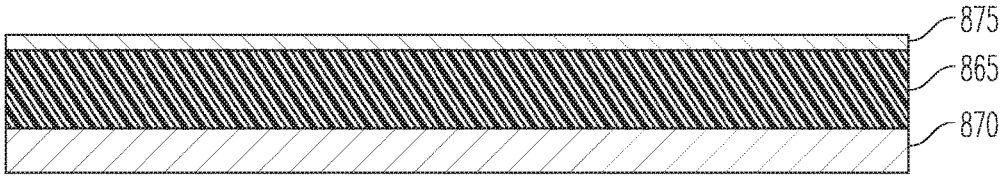
Figure 8C:
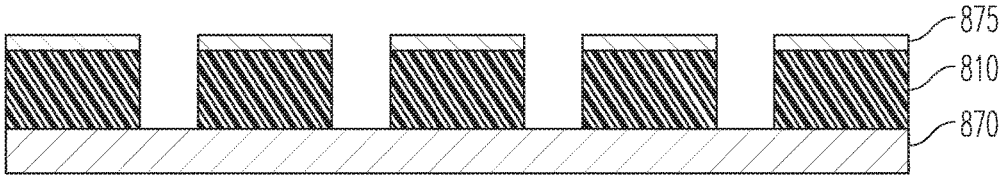
Figure 8D:
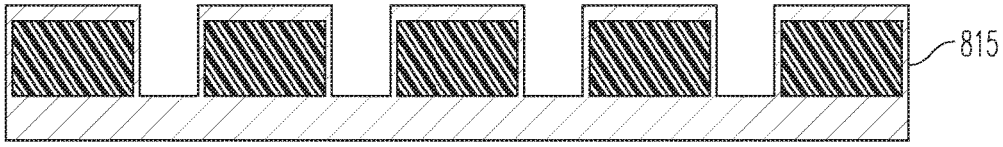

FIGS. 8A-8D are illustrations of an embodiment of a method of making a waveguide ribbon that includes multiple waveguides. In FIGS. 8A and 8B the dielectric sheet 865 is joined to a first conductive sheet 870 in a similar manner as in FIGS. 7A and 7B. The difference in the example of FIGS. 8A and 8B is that a second conductive sheet 875 is joined to the top surface of the dielectric sheet 870 to form the top surface of the conductive layer around the waveguide cores. The second conductive sheet 875 may be joined by laminating or adhesive in a similar manner as in the example of FIGS. 7A-7D. The second conductive sheet 875 may be joined at the same time the first conductive sheet and dielectric sheet are joined together or can be joined afterward as a second step. As shown in FIG. 8C, both the second conductive sheet 875 and the dielectric sheet 865 are patterned to form dielectric waveguide cores 810 on the first conductive sheet 870 and to expose side surfaces of the dielectric waveguide cores. In certain embodiments, the second conductive sheet and the dielectric sheet are patterned at the same time. In certain embodiments, the dielectric layer may be partially patterned or processed before the second conductive sheet is joined to the dielectric sheet. In FIG. 8D, the formed dielectric waveguide cores are coated with a conductive layer 815 of substantially the same conductive material as the conductive sheets to form the plurality of waveguides.

The examples in FIGS. 7A-7D and 8A-8D show one layer of waveguides being fabricated to form waveguide ribbons. FIGS. 7A-7D and 8A-8D show a layer of five waveguides for simplicity, but the layer can include many more waveguides and the waveguide ribbon can be slit to include the desired number of waveguides and the waveguide ribbons can be cut to the desired length. Additionally, the processes of FIGS. 7A-7D and 8A-8D can be repeated to add layers of waveguides to create a waveguide bundle as in FIG. 6.

Figure 7E:
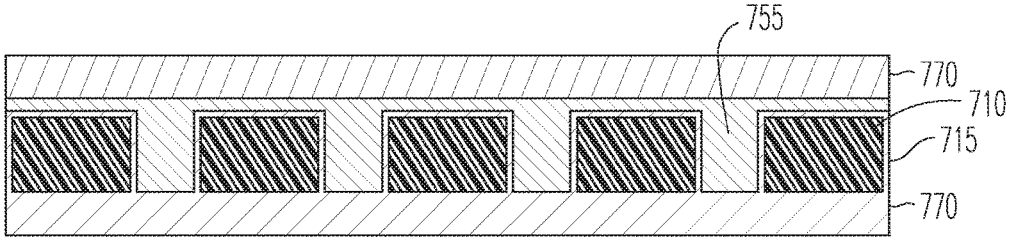
Figure 7F:
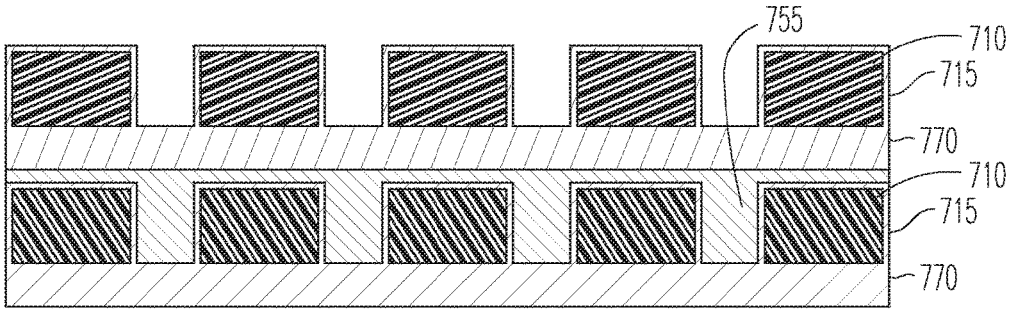

As shown in the embodiments of FIGS. 7E and 7F, the conductive layer 715 of waveguides of FIG. 7D can be coated with a non-dielectric nonconductive filler material 755 before a second conductive sheet 770 of the conductive material is joined to the top surface of the coated waveguides as shown in FIG. 7E. If the space between waveguides is small, the second conductive sheet can be applied to the coated waveguides. If desired, any space between the waveguides can be filled with the non-dielectric material or a dielectric material different from the dielectric material of the sheet of dielectric material used to make the waveguide cores. A second sheet of dielectric material is joined to the second conductive sheet and patterned to form a second layer of dielectric waveguide cores 710 on the second conductive sheet as shown in FIG. 7F. The second layer of the dielectric waveguide cores 710 may then be coated 715 with substantially the same conductive material as the second conductive sheet to form the second layer of waveguides. The process can be repeated to form a third layer of waveguides as in the waveguide bundle shown in FIG. 6. The waveguide bundle can include many waveguides in a layer. The waveguide bundles can be slit to include the desired number of waveguides.

Figure 9A:
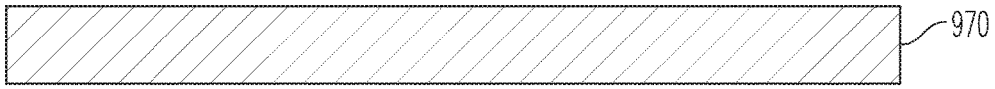
FIGS. 9A-9F are illustrations of still another embodiment of making multiple waveguides in accordance with some embodiments.
Figure 9B:
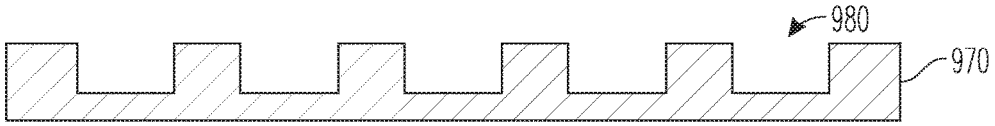
Figure 9C:
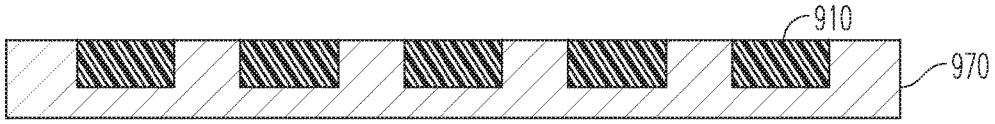
Figure 9D:
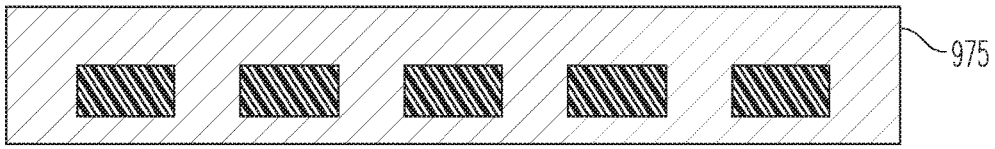
Figure 9E:
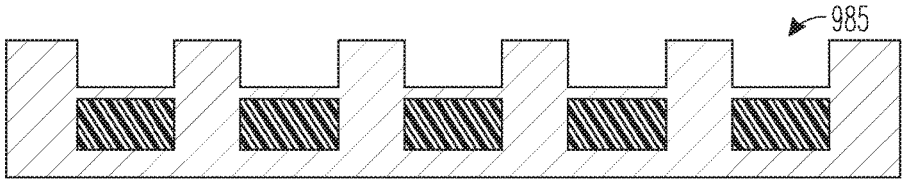
Figure 9F:
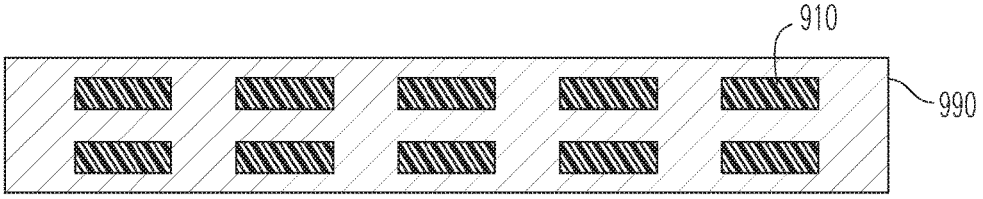

FIGS. 9A-9F are illustrations of another embodiment of a method of making a waveguide ribbon or waveguide bundle. The process starts in FIG. 9A with a sheet of conductive material 970. In FIG. 9B, trenches 980 can be formed in the conductive sheet. The trenches can be formed by cutting, machining, or etching. The trenches form a portion of the waveguides. In the example of FIG. 9B, a trench forms three sides of a waveguide. In FIG. 9C, the trenches are filled with a dielectric material 910 to form waveguide cores for the waveguides. In some embodiments, a primer coating is applied to the trenches prior to filling the trenches with the dielectric material to improve bonding between the conductive layer and dielectric core of the waveguides. In FIG. 9D, a second sheet 975 of the conductive material is joined to the first conductive sheet 970 above the waveguide cores to form a ribbon of waveguides. If it is desired to form additional layers of waveguides to form one or more waveguide bundles, in FIG. 9E a second conductive sheet 985 can be formed in second conductive sheet 975 and filled with the dielectric material to form a second set of waveguide cores. In FIG. 9F, a third conductive sheet can be joined to the second conductive sheet above the waveguide cores to form a second layer of waveguides. The process can be repeated to add the desired number of layers of waveguides.

Figure 10:
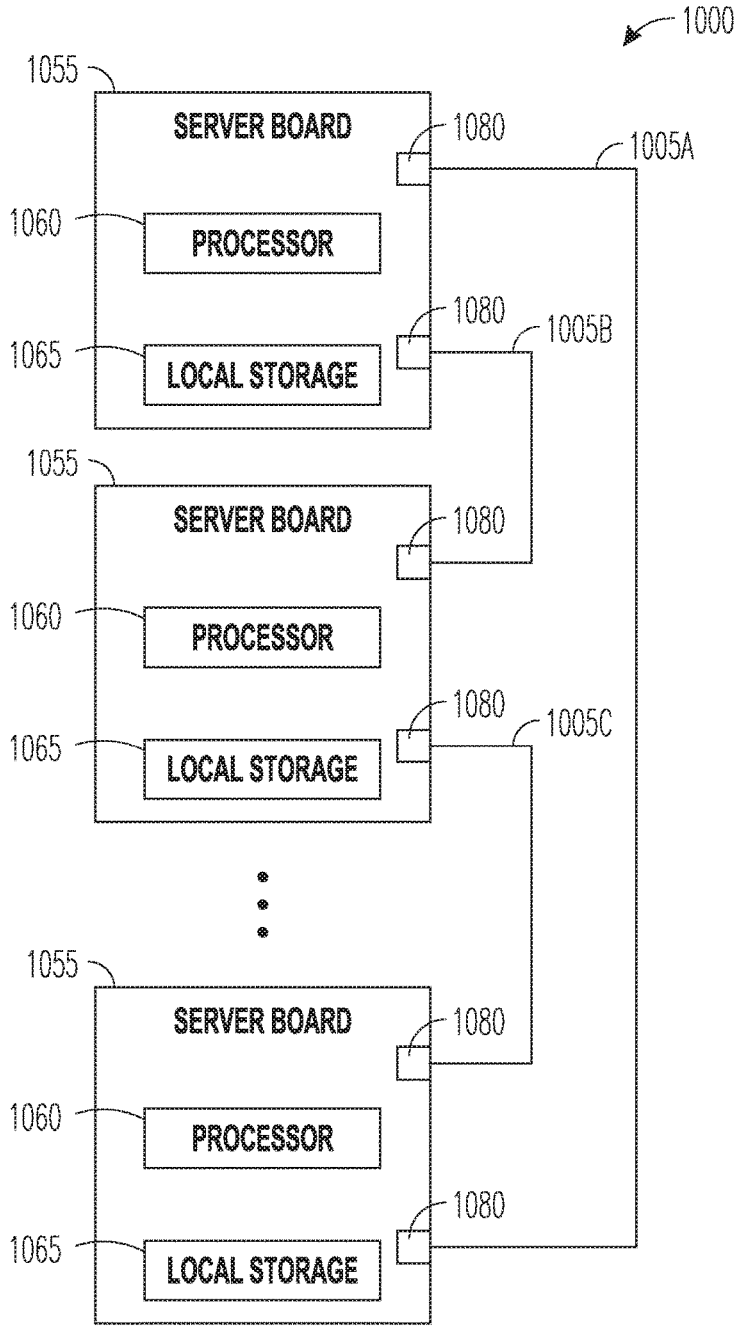
FIG. 10 is a block diagram of an electronic system in accordance with some embodiments.

FIG. 10 is a block diagram of an electronic system 1000 incorporating waveguide assemblies in accordance with at least one embodiment of the invention. Electronic system 1000 is merely one example in which embodiments of the present invention can be used. The electronic system 1000 of FIG. 10 comprises multiple servers or server boards 1055 interconnected as a server cluster that may provide internet cloud services. A server board 1055 may include one or more processors 1060 and local storage 1065. Only three server boards are shown to simplify the example in FIG. 10. A server cluster may include hundreds of servers arranged on boards or server blades in a rack of servers, and a server cluster can include dozens of racks of server blades. Racks can be placed side-by-side with a back-plane or back-panel used to interconnect the racks. Server switching devices can be included in the racks of the server cluster to facilitate switching among the hundreds of servers.

The server boards in FIG. 10 include ports 1080. The ports 1080 of the server boards are shown interconnected using waveguides 1005A, 1005B, and 1005C, although an actual system would include hundreds of rack-to-rack and within rack interconnections. The waveguides may represent multiple waveguides having multiple connections to the server boards. The multiple waveguides may be arranged parallel to each other and may be physically connected to each other as a waveguide ribbon or a waveguide bundle. The waveguides may be used to interconnect multiple server ports between the servers.

There can be multiple levels of interconnect between servers. These levels can include within server blade interconnect, within server rack interconnect, rack-to-rack interconnect and rack-to-switch interconnect. The waveguides 1005A, 1005B, and 1005C are used for at least a portion of the interconnect within the server system, and can be used for any of the within server blade, within server rack, rack-to-rack, and rack-to-switch interconnections. In certain embodiments, the waveguides form at least a portion of back-panel interconnections for a server cluster.

Figure 11:
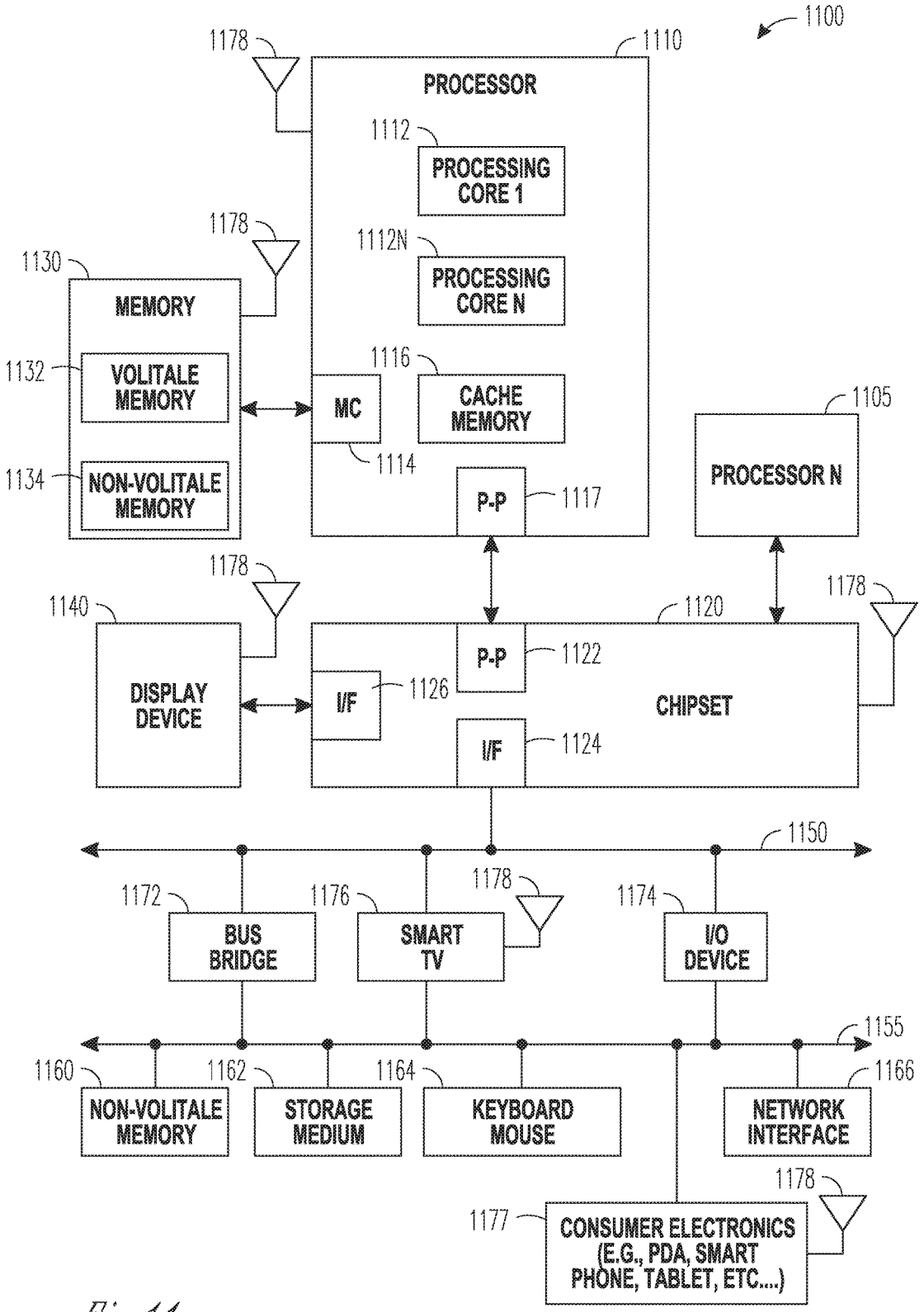
FIG. 11 is a block diagram of another electronic system in accordance with some embodiments.

FIG. 11 illustrates a system level diagram, according to one embodiment of the invention. For instance, FIG. 11 depicts an example of an electronic device (e.g., system) that can include the waveguide interconnections as described in the present disclosure. In one embodiment, system 1100 includes, but is not limited to, a desktop computer, a laptop computer, a netbook, a tablet, a notebook computer, a personal digital assistant (PDA), a server, a workstation, a cellular telephone, a mobile computing device, a smart phone, an Internet appliance or any other type of computing device. In some embodiments, system 1100 is a system on a chip (SOC) system. In one example, two or more systems as shown in FIG. 11 may be coupled together using one or more waveguides as described in the present disclosure. In one specific example, one or more waveguides as described in the present disclosure may implement one or more of busses 1150 and 1155.

In one embodiment, processor 1110 has one or more processing cores 1112 and 1112N, where N is a positive integer and 1112 represents the first processor core and 1112N represents the Nth processor core inside processor 1110. In one embodiment, system 1100 includes multiple processors including 1110 and 1105, where processor 1105 has logic similar or identical to the logic of processor 1110. In some embodiments, first processing core 1112 includes, but is not limited to, pre-fetch logic to fetch instructions, decode logic to decode the instructions, execution logic to execute instructions and the like. In some embodiments, processor 1110 has a cache memory 1116 to cache instructions and/or data for system 1100. Cache memory 1116 may be organized into a hierarchal structure including one or more levels of cache memory In some embodiments, processor 1110 includes a memory controller (MC) 1114, which is operable to perform functions that enable the processor 1110 to access and communicate with memory 1130 that includes a volatile memory 1132 and/or a non-volatile memory 1134. In some embodiments, processor 1110 is coupled with memory 1130 and chipset 1120. Processor 1110 may also be coupled to a wireless antenna interface 1178 to communicate with any device configured to transmit and/or receive wireless signals. In one embodiment, the wireless antenna interface 1178 operates in accordance with, but is not limited to, the IEEE 802.11 standard and its related family, Home Plug AV (HPAV), Ultra Wide Band (UWB), Bluetooth, WiMax, or any form of wireless communication protocol.

In some embodiments, volatile memory 1132 includes, but is not limited to, Synchronous Dynamic Random Access Memory (SDRAM), Dynamic Random Access Memory (DRAM), RAMBUS Dynamic Random Access Memory (RDRAM), and/or any other type of random access memory device. Non-volatile memory 1134 includes, but is not limited to, flash memory, phase change memory (PCM), read-only memory (ROM), electrically erasable programmable read-only memory (EEPROM), or any other type of non-volatile memory device.

Memory 1130 stores information and instructions to be executed by processor 1110. In one embodiment, memory 1130 may also store temporary variables or other intermediate information while processor 1110 is executing instructions. In the illustrated embodiment, chipset 1120 connects with processor 1110 via Point-to-Point (PtP or P-P) interfaces 1117 and 1122. Chipset 1120 enables processor 1110 to connect to other elements in system 1100. In some embodiments of the invention, interfaces 1117 and 1122 operate in accordance with a PtP communication protocol such as the Intel® QuickPath Interconnect (QPI) or the like. In other embodiments, a different interconnect may be used.

In some embodiments, chipset 1120 is operable to communicate with processors 1110, 1105, display device 1140, and other devices 1172, 1176, 1174, 1160, 1162, 1164, 1166, 1177, etc. Buses 1150 and 1155 may be interconnected together via a bus bridge 1172. Chipset 1120 connects to one or more buses 1150 and 1155 that interconnect various elements 1174, 1160, 1162, 1164, and 1166. Chipset 1120 may also be coupled to a wireless antenna interface 1178 to communicate with any device configured to transmit and/or receive wireless signals. Chipset 1120 connects to display device 1140 via interface (I/F) 1126. Display 1140 may be, for example, a liquid crystal display (LCD), a plasma display, cathode ray tube (CRT) display, or any other form of visual display device. In some embodiments of the invention, processor 1110 and chipset 1120 are merged into a single SOC. In one embodiment, chipset 1120 couples with a non-volatile memory 1160, a mass storage medium 1162, a keyboard/mouse 1164, and a network interface 1166 via interface (I/F) 1124 and/or I/F 1126, I/O devices 1174, smart TV 1176, consumer electronics 1177 (e.g., PDA, Smart Phone, Tablet, etc.).

In one embodiment, mass storage medium 1162 includes, but is not limited to, a solid state drive, a hard disk drive, a universal serial bus flash memory drive, or any other form of computer data storage medium. In one embodiment, network interface 1166 is implemented by any type of well-known network interface standard including, but not limited to, an Ethernet interface, a universal serial bus (USB) interface, a Peripheral Component Interconnect (PCI) Express interface, a wireless interface and/or any other suitable type of interface. In one embodiment, the wireless antenna interface 1178 operates in accordance with, but is not limited to, the IEEE 802.11 standard and its related family. Home Plug AV (HPAV), Ultra Wide Band (UWB), Bluetooth, WiMax, or any form of wireless communication protocol.

While the modules shown in FIG. 11 are depicted as separate blocks within the system 1100, the functions performed by some of these blocks may be integrated within a single semiconductor circuit or may be implemented using two or more separate integrated circuits. For example, although cache memory 1116 is depicted as a separate block within processor 1110, cache memory 1116 (or selected aspects of 1116) can be incorporated into processor core 1112.

ADDITIONAL DESCRIPTION AND EXAMPLES

Example 1 includes subject matter (such as a method of making a waveguide ribbon that includes a plurality of waveguides) comprising: joining a first sheet of dielectric material to a first conductive sheet of conductive material; patterning the first sheet of dielectric material to form a plurality of dielectric waveguide cores on the first conductive sheet; and coating the dielectric waveguide cores with substantially the same conductive material as the conductive sheet to form the plurality of waveguides.

In Example 2, the subject matter of Example 1 optionally includes joining a second conductive sheet of the conductive material to a top surface of the first sheet of dielectric material; patterning both the second conductive sheet and the first sheet of dielectric material to expose side surfaces of the dielectric waveguide cores, and spraying the conductive material onto the exposed side surfaces of the dielectric waveguide cores.

In Example 3, the subject matter of one or both of Examples 1 and 2 optionally includes at least one of spraying or brushing the conductive material onto the exposed surfaces of the dielectric waveguide cores.

In Example 4, the subject matter of one or both of Examples 1 and 2 optionally includes plating the conductive material onto the exposed surfaces of the dielectric waveguide cores.

In Example 5, the subject matter of one or any combination of Examples 1-4 optionally includes coating the waveguides with a non-dielectric nonconductive filler material; joining a second conductive sheet of the conductive material to a top surface of the coated waveguides; joining a second sheet of dielectric material to the second conductive sheet; patterning the second sheet of dielectric material to form a plurality of dielectric waveguide cores on the second conductive sheet; and coating the dielectric waveguide cores on the second conductive sheet with substantially the same conductive material as the second conductive sheet.

In Example 6, the subject matter of one or any combination of Examples 1-5 optionally includes filling space between the waveguides with a dielectric material different from the dielectric material of the first sheet of dielectric material.

In Example 7, the subject matter of one or any combination of Examples 1-6 optionally includes laminating the first sheet of dielectric material to the first conductive sheet.

In Example 8, the subject matter of one or any combination of the Examples 1-7 optionally includes applying an adhesive layer to one or both of the first sheet of dielectric material and the first conductive sheet; and adhering the first sheet of dielectric material to the first conductive sheet using the adhesive layer.

In Example 9, the subject matter of one or any combination of Examples 1-8 optionally includes conductive material that includes a conductive polymer.

In Example 10, the subject matter of one or any combination of Examples 1-9 optionally includes a dielectric material that includes at least one of polyethylene (PE), polytetrafluoroethylene (PTFE), perfluoroalkoxy alkanes (PFA), fluorinated ethylene propylene (FEP), polyvinylidene fluoride (PVDF), ethylene-tetraflouroethylene (ETFE), a printed circuit board material, or an electronic packaging substrate material.

In Example 11, the subject matter of one or any combination of Examples 1-10 optionally includes covering an outer surface of the conductive material of the waveguides with a protective material.

In Example 12, the subject matter of one or any combination of Examples 1-11 optionally includes cutting the dielectric material on the first conductive sheet to form the plurality of parallel dielectric waveguide cores using at least one of laser cutting and mechanical cutting.

In Example 13, the subject matter of one or any combination of Examples 1-12 optionally includes photo-patterning and etching the dielectric material on the first conductive sheet to form the plurality of parallel dielectric waveguide cores.

In Example 14, the subject matter of one or any combination of Examples 1-13 optionally includes at least one of stamping the dielectric material on the first conductive sheet or embossing the dielectric material on the first conductive sheet to form the plurality of parallel dielectric waveguide cores.

Example 15 can include subject matter (such as a method of making a waveguide ribbon that includes a plurality of waveguides), or can optionally be combined with one or any combination of Examples 1-14 to include such subject matter, comprising: forming a plurality of trenches in a first conductive sheet of conductive material to form a portion of each of the waveguides; filling the trenches with a dielectric material to form waveguide cores of the waveguides; and joining a second conductive sheet of the conductive material above the waveguide cores to form the waveguides.

In Example 16, the subject matter of Example 15 optionally includes forming a second plurality of trenches in the second conductive sheet; filling the second plurality of trenches with the dielectric material to form a second plurality of waveguide cores; and joining a third conductive sheet above the waveguide cores to form a second plurality of waveguides.

In Example 17, the subject matter of one or both of Examples 15 and 16 optionally includes filling the trenches with at least one of polyethylene (PE), polytetrafluoroethylene (PTFE), perfluoroalkoxy alkanes (PFA), fluorinated ethylene propylene (FEP), polyvinylidene fluoride (PVDF), or ethylene-tetraflouroethylene (ETFE) to form the waveguide cores of the waveguides.

In Example 18, the subject matter of one or any combination of Examples 15-17 optionally includes applying a primer coating to the trenches prior to filling the trenches with the dielectric material.

In Example 19, the subject matter of one or any combination of Examples 15-18 optionally includes forming the trenches using at least one of laser cutting or mechanical cutting.

Example 20 can include subject matter (such as an apparatus), or can optionally by combined with one or any combination of Examples 1-19 to include such subject matter, comprising a plurality of waveguides, wherein the waveguides include waveguide ends and the waveguides are arranged parallel to each other between the waveguide ends as a first layer of waveguides, wherein the waveguides include dielectric waveguide cores and a conductive layer arranged around each of the dielectric waveguide cores.

In Example 21, the subject matter of Example 20 optionally includes a second layer of waveguides is arranged on the first layer of waveguides.

In Example 22, the subject matter of one or both of Examples 20 and 21 optionally includes a dielectric waveguide cores including at least one of polyethylene (PE), polytetrafluoroethylene (PTFE), perfluoroalkoxy alkanes (PFA), fluorinated ethylene propylene (FEP), polyvinylidene fluoride (PVDF), or ethylene-tetraflouroethylene (ETFE).

In Example 23, the subject matter of one or any combination of Examples 20-22 optionally includes a width of a waveguide of the plurality of waveguides being two millimeters (2 mm) or greater, and the length of the waveguide being one half meter (0.5 m) or longer.

In Example 24, the subject matter of one or any combination of Examples 20-23 optionally includes a plurality of waveguide transceiver circuits operatively coupled to the plurality of waveguides.

Example 25 can include subject matter (such as an apparatus), or can optionally be combined with one or any combination of Examples 1-24 to include such subject matter comprising: a first server and a second server, wherein the first server includes a first plurality of ports and the second server includes a second plurality of ports; and a plurality of waveguides including dielectric waveguide cores and a conductive layer arranged around each of the dielectric waveguide cores, wherein first ends of the plurality of waveguides are operatively coupled to the first plurality of ports of the first server and second ends of the plurality of waveguides are operatively coupled to the second plurality of ports of the second server.

In Example 26, the subject matter of Example 25 optionally includes the waveguides arranged parallel to each other and physically connected to each other as a waveguide bundle.

In Example 27, the subject matter of one or both of Example 25 and Example 26 optionally includes a width of a waveguide of the plurality of waveguides being two millimeters (2 mm) or greater, and the length of the waveguide being one half meter (0.5 m) or longer.

In Example 28, the subject matter of one or any combination of Examples 25-27 optionally includes the waveguides operatively coupled to the first plurality of ports of the first server and to the second plurality of ports of the second server using a plurality of waveguide transceiver circuits and a plurality of waveguide launchers.

In Example 29, the subject matter of one or any combination of Examples 25-28 optionally includes the dielectric waveguide cores including at least one of polyethylene (PE), polytetrafluoroethylene (PTFE), perfluoroalkoxy alkanes (PFA), fluorinated ethylene propylene (FEP), polyvinylidene fluoride (PVDF), or ethylene-tetraflouroethylene (ETFE).

In Example 30, the subject matter of one or any combination of Examples 25-29 optionally includes the conductive layer including a conductive polymer.

These several Examples can be combined using any permutation or combination. The Abstract is provided to allow the reader to ascertain the nature and gist of the technical disclosure. It is submitted with the understanding that it will not be used to limit or interpret the scope or meaning of the claims. The following claims are hereby incorporated into the detailed description, with each claim standing on its own as a separate embodiment.

What is claimed is:

1. A method of making a waveguide ribbon that includes a plurality of dielectric waveguides, the method comprising:

joining a first sheet of dielectric material to a first conductive sheet of conductive material;

joining a second conductive sheet of the conductive material to a top surface of the first sheet of dielectric material;

patterning both the second conductive sheet and the first sheet of dielectric material to form a plurality of dielectric waveguide cores and to expose side surfaces of the plurality of dielectric waveguide cores; and coating the plurality of dielectric waveguide cores with substantially the same conductive material as the first and second conductive sheets by applying the conductive material onto the exposed side surfaces of the dielectric waveguide cores to form the plurality of dielectric waveguides.

2. The method of claim 1, wherein coating the plurality of dielectric waveguide cores includes spraying the conductive material onto the exposed side surfaces of the plurality of dielectric waveguide cores.

3. The method of claim 1, wherein coating the plurality of dielectric waveguide cores includes brushing the conductive material onto the exposed surfaces of the plurality of dielectric waveguide cores.

4. The method of claim 1, wherein coating the plurality of dielectric waveguide cores includes plating the conductive material onto the exposed surfaces of the plurality of dielectric waveguide cores.

5. The method of claim 1, wherein patterning the first sheet of dielectric material and the second conductive sheet includes at least one of stamping the dielectric material on the first conductive sheet or embossing the dielectric material on the first conductive sheet to form the plurality of dielectric waveguide cores in parallel to each other.

6. The method of claim 1, including filling spaces between the plurality of waveguide cores with a dielectric material different from the dielectric material of the first sheet of dielectric material.

7. The method of claim 1, wherein joining the first sheet of dielectric material to the first conductive sheet of conductive material includes laminating the first sheet of dielectric material to the first conductive sheet.

8. The method of claim 1, wherein joining the first sheet of dielectric material to the first conductive sheet includes: applying an adhesive layer to one or both of the first sheet of dielectric material and the first conductive sheet; and adhering the first sheet of dielectric material to the first conductive sheet using the adhesive layer.

9. The method of claim 1, wherein the conductive material includes a conductive polymer.

10. The method claim 1, wherein the dielectric material includes at least one of polyethylene (PE), polytetrafluoroethylene (PTFE), perfluoroalkoxy alkanes (PFA), fluorinated ethylene propylene (FEP), polyvinylidene fluoride (PVDF), ethylene-tetraflouroethylene (ETFE), a printed circuit board material, or an electronic packaging substrate material.

11. The method of claim 1, wherein patterning the first sheet of dielectric material and the second conductive sheet includes cutting the dielectric material on the first conductive sheet to form the plurality of dielectric waveguide cores in parallel to each other by using at least one of laser cutting and mechanical cutting.

12. The method of claim 1, wherein patterning the first sheet of dielectric material and the second conductive sheet includes photo-patterning and etching the dielectric material on the first conductive sheet to form the plurality of dielectric waveguide cores in parallel to each other.

13. A method of making a waveguide ribbon that includes a plurality of waveguides, the method comprising:

forming a plurality of trenches in a first conductive sheet of conductive material to form a portion of each of the waveguides;

filling the trenches with a respective dielectric material to form corresponding waveguide cores of the plurality of dielectric waveguides;

joining a second conductive sheet of the conductive material above the waveguide cores to form the waveguides;

forming a second plurality of trenches in the second conductive sheet;

filling the second plurality of trenches with the respective dielectric material to form a second plurality of waveguide cores; and joining a third conductive sheet above the waveguide cores to form a second plurality of waveguides.

14. The method of claim 13, wherein filling the trenches with the respective dielectric material includes filling the trenches with at least one of polyethylene (PE), polytetrafluoroethylene (PTFE), perfluoroalkoxy alkanes (PFA), fluorinated ethylene propylene (FEP), polyvinylidene fluoride (PVDF), or ethylene-tetraflouroethylene (ETFE) to form the waveguide cores of the waveguides.

15. An apparatus comprising:

a plurality of waveguides, wherein each of the plurality of waveguides include respective waveguide ends and the plurality of waveguides are arranged parallel to each other between the waveguide ends as a first layer of waveguides, wherein each of the plurality of waveguides include respective dielectric waveguide cores and a corresponding conductive layer arranged around each of the dielectric waveguide cores, wherein the conductive material includes a conductive polymer.

16. The apparatus of claim 15, including a plurality of waveguide transceiver circuits operatively coupled to the plurality of waveguides.

17. The apparatus of claim 15, wherein the respective dielectric waveguide cores include includes at least one of polyethylene (PE), polytetrafluoroethylene (PTFE), perfluoroalkoxy alkanes (PFA), fluorinated ethylene propylene (FEP), polyvinylidene fluoride (PVDF), or ethylene-tetraflouroethylene (ETFE).

18. The apparatus of claim 15, wherein a second layer of waveguides is arranged on the first layer of waveguides.

19. An apparatus comprising:

a first server board and a second server board, wherein the first server board includes a first plurality of ports and the second server board includes a second plurality of ports; and plurality of waveguides including dielectric waveguide cores and a conductive layer arranged around each of the dielectric waveguide cores, wherein first ends of the plurality of waveguides are operatively coupled to the first plurality of ports of the first server board and second ends of the plurality of waveguides are operatively coupled to the second plurality of ports of the second server board, wherein a width of a respective waveguide of the plurality of waveguides is two millimeters (2 mm) or greater, and the length of the respective waveguide is one half meter (0.5 m) or longer.

20. The apparatus of claim 19, wherein the respective dielectric waveguide cores include at least one of polyethylene (PE), polytetrafluoroethylene (PTFE), perfluoroalkoxy alkanes (PFA), fluorinated ethylene propylene (FEP), polyvinylidene fluoride (PVDF), or ethylene-tetraflouroethylene (ETFE).

21. The apparatus of claim 19, wherein the plurality of waveguides are operatively coupled to the first plurality of ports of the first server board and to the second plurality of ports of the second server board using a plurality of waveguide transceiver circuits and a plurality of waveguide launchers.

22. The apparatus of claim 19, wherein the plurality of waveguides are arranged parallel to each other and are physically connected to each other as a waveguide bundle.

* * * * *